United States Patent [19]

Adams, Sr.

[11] 4,141,085

[45] Feb. 27, 1979

[54] VENTED HELMET AND FACE SHIELD

[76] Inventor: John Adams, Sr., 2778 N. 19th St., Milwaukee, Wis. 53206

[21] Appl. No.: 835,715

[22] Filed: Sep. 22, 1977

[51] Int. Cl.[2] ..... A42B 3/00; A12C 5/04; A61F 9/06

[52] U.S. Cl. ..... 2/410; 2/424; 2/436

[58] Field of Search ..... 2/6, 410, 424, 425, 2/435, 436, 437, 414, 421, 411, 412, 426

[56] References Cited

U.S. PATENT DOCUMENTS

| | | | |
|---|---|---|---|
| 3,423,758 | 1/1969 | Heacox | 2/424 |
| 3,496,854 | 2/1970 | Feldman et al. | 2/410 X |
| 3,517,393 | 6/1970 | Beauchef | 2/436 |
| 3,783,450 | 1/1974 | O'Connor | 2/425 X |
| 3,925,821 | 12/1975 | Lewicki | 2/425 |
| 4,081,865 | 4/1978 | Bergee | 2/245 |

FOREIGN PATENT DOCUMENTS

| | | | |
|---|---|---|---|
| 1380221 | 10/1964 | France | 2/436 |

*Primary Examiner*—Louis Rimrodt
*Attorney, Agent, or Firm*—Daniel Jay Tick

[57] ABSTRACT

A safety helmet has a plurality of air vents formed therein in mutually spaced relation. A face shield is affixed to the helmet and has a plurality of air vents formed therein in mutually spaced relation.

1 Claim, 3 Drawing Figures

VENTED HELMET AND FACE SHIELD

BACKGROUND OF THE INVENTION:

The present invention relates to a vented helmet and face shield.

Objects of the invention are to provide a vented helmet and face shield of simple structure, which is inexpensive in manufacture, and functions efficiently, effectively and reliably to provide air circulation in the helmet during hot weather thereby cooling the helmet for the wearer and enhancing his or her comfort so that the wearer is induced to continue wearing the helmet regardless of the heat and thereby protect himself or herself from possible injury.

BRIEF DESCRIPTION OF THE DRAWINGS:

In order that the invention may be readily carried into effect, it will now be described with reference to the accompanying drawings, wherein.

DETAILED DESCRIPTION OF THE INVENTION:

The vented helmet and face shield of the invention comprises a safety helmet 1 (FIGS. 1 to 3) having a plurality of air vents formed therein in mutually spaced relation. The air vents 2 and 3 are shown in FIG. 1 and the air vent 2 is shown in FIGS. 2 and 3.

Figure 1:
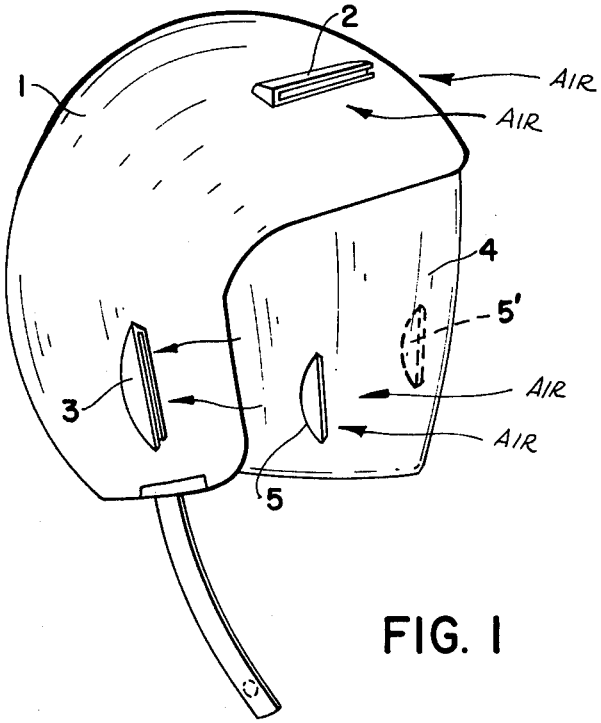
FIG. 1 is a perspective view of an embodiment of the vented helmet and face shield of the invention.

A face shield 4 is affixed to the helmet 1, as shown in FIG. 1, and has a plurality of air vents formed therein in mutually spaced relation. The air vents 5 and 5' of the face shield 4 is shown in FIG. 1.

Figure 2:
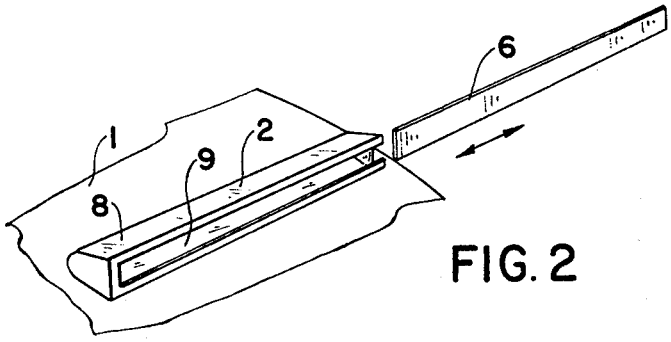
FIG. 2 is a perspective view, on an enlarged scale, of an embodiment of an air vent of the vented helmet of the invention.
Figure 3:
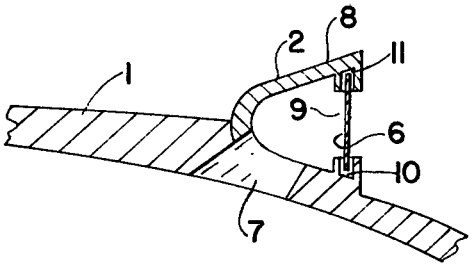
FIG. 3 is a cross-sectional view, on an enlarged scale, of the embodiment of FIG. 3.

Each of the air vents 2, 3, 5 and 5' has a movable closing member such, as for example, the closing member 6 of the air vent 2, and is selectively openable and closable via said closing member (FIGS. 2 and 3).

As shown in FIGS. 2 and 3, each of the air vents comprises a slot 7 through the helmet or face shield (FIG. 3). A raised cover 8 (FIGS. 2 and 3) is provided over the slot and spaced from the helmet or face plate through which the slot is formed to form an opening 9 (FIGS. 2 and 3). A pair of spaced parallel grooves 10 and 11 are formed in the cover 8 on opposite sides of the opening 9 and extend along the length of the opening, as shown in FIG. 3.

The closing member 6 is movably mounted in the grooves 10 and 11 in a manner whereby said closing member completely covers the opening 9 when it is inserted in the grooves. Thus, in warm weather, the closing member 6 is not inserted in the covers of the air vents, so that air is free to circulate through the helmet and around the face of the wearer. In cold weather, however, the closing member 6 is manually moved along the grooves 10 and 11 of the cover of each of the air vents to close the opening 9 of the air vent to a desired extent.

While the invention has been described by means of a specific example and in a specific embodiment, I do not wish to be limited thereto, for obvious modifications will occur to those skilled in the art without departing from the spirit and scope of the invention.

Helmets of the type described in the present application are disclosed in U.S. Pat. Nos. 2,619,639; 2,663,874; 2,777,127; 3,409,909; 3,491,371 and 3,548,411.

I claim:

1. A vented helmet and face shield, comprising a safety helmet having a plurality of air vents formed therein in mutually spaced relation; and a face shield affixed to the helmet and having a plurality of air vents formed therein in mutually spaced relation, each of the air vents having a movable closing member and being selectively openable and closable via the closing member, each of said air vents comprising a slot, a raised cover over the slot spaced from the corresponding one of the helmet and face plate to form an opening, a pair of spaced parallel grooves formed in the cover on opposite sides of the opening and extending along the length of the opening and a closing member movably mounted in the grooves in a manner whereby said closing member selectively opens and closes the opening to a desired extent when it is inserted in said grooves.

* * * * *